US007094450B2

(12) United States Patent
Nagaraj et al.

(10) Patent No.: US 7,094,450 B2
(45) Date of Patent: Aug. 22, 2006

(54) METHOD FOR APPLYING OR REPAIRING THERMAL BARRIER COATINGS

(75) Inventors: Bangalore Aswatha Nagaraj, West Chester, OH (US); Eva Zielonka Lanman, Milford, OH (US); Deborah Anne Schorr, Cincinnati, OH (US); Thomas John Tomlinson, West Chester, OH (US); Raymond William Heidorn, Fairfeld, OH (US); David Allen Kastrup, West Chester, OH (US); Craig Douglas Young, Maineville, OH (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 10/426,280

(22) Filed: Apr. 30, 2003

(65) Prior Publication Data

US 2004/0219290 A1 Nov. 4, 2004

(51) Int. Cl.
*C23C 4/06* (2006.01)
*C23C 4/10* (2006.01)

(52) U.S. Cl. ..... 427/454; 427/455; 427/456; 427/142; 29/889.1

(58) Field of Classification Search ..... 427/454, 427/455, 456, 142; 29/889.1, 889.71
See application file for complete search history.

(56) References Cited

U.S. PATENT DOCUMENTS 4,028,787 A * 6/1977 Cretella et al. ..... 29/889.1
4,095,003 A 6/1978 Weatherly et al.
4,148,275 A 4/1979 Benden et al.
4,339,282 A 7/1982 Lada et al.
4,353,780 A 10/1982 Fishter et al.
4,411,730 A 10/1983 Fishter et al.
4,563,239 A 1/1986 Adinolfi et al.
4,741,286 A 5/1988 Itoh et al.
4,756,765 A 7/1988 Woodroffe (Continued)

FOREIGN PATENT DOCUMENTS

| | | |
|---|---|---|
| EP | 0808913 | 11/1997 |
| EP | 1016735 | 7/2000 |
| EP | 1304446 | 4/2003 |
| GB | 2375725 | 11/2002 |
| JP | 8176781 | 7/1996 |

OTHER PUBLICATIONS

Thermal Spraying: Practice, Theory, and Application, American Welding Society, Inc., 1985, pp. 16–19 and 22.*
Thermal Spraying: Practice, Theory, and Application, American Welding Society, Inc. 1985. pp. 16–18.*

*Primary Examiner*—Katherine A. Bareford
(74) *Attorney, Agent, or Firm*—Eric W. Guttag; Jagtiani & Guttag; David L. Narcisco

(57) ABSTRACT

A method applying a thermal barrier coating to a metal substrate, or for repairing a thermal barrier coating previously applied by physical vapor deposition to an underlying aluminide diffusion coating that overlays the metal substrate. The aluminide diffusion coating is treated to make it more receptive to adherence of a plasma spray-applied overlay alloy bond coat layer. An overlay alloy bond coat material is then plasma sprayed on the treated aluminide diffusion coating to form an overlay alloy bond coat layer. A ceramic thermal barrier coating material is plasma sprayed on the overlay alloy bond coat layer to form the thermal barrier coating. In the repair embodiment of this method, the physical vapor deposition-applied thermal barrier coating is initially removed from the underlying aluminide diffusion coating.

12 Claims, 4 Drawing Sheets

U.S. PATENT DOCUMENTS 4,885,213 A 12/1989 Miyamoto et al.
4,914,918 A 4/1990 Sullivan
5,047,612 A 9/1991 Savkar et al.
5,313,700 A * 5/1994 Dorman ..... 29/889.7
5,332,598 A 7/1994 Kawasaki et al.
5,419,971 A 5/1995 Skelly et al.
5,435,889 A 7/1995 Dietrich
5,480,301 A * 1/1996 Farzin-Nia et al. ..... 433/9
5,645,893 A 7/1997 Rickerby et al.
5,705,082 A 1/1998 Hinson
5,716,720 A 2/1998 Murphy
5,723,078 A 3/1998 Nagaraj et al.
5,728,227 A 3/1998 Reverman
5,866,271 A * 2/1999 Stueber et al. ..... 428/545
5,900,102 A * 5/1999 Reeves ..... 156/344
5,928,725 A 7/1999 Howard et al.
5,972,424 A * 10/1999 Draghi et al. ..... 427/142
6,039,810 A 3/2000 Mantkowski et al.
6,042,880 A 3/2000 Rigney et al.
6,274,193 B1 8/2001 Rigney et al.
6,442,940 B1 9/2002 Young et al.
6,447,854 B1 9/2002 Rigney et al.
6,465,040 B1 10/2002 Gupta et al.
6,471,881 B1 10/2002 Chai et al.
6,482,469 B1 11/2002 Spitsberg et al.
6,494,960 B1 12/2002 Macdonald et al.
6,502,400 B1 1/2003 Freidauer et al.
6,503,574 B1 1/2003 Skelly et al.

* cited by examiner

METHOD FOR APPLYING OR REPAIRING THERMAL BARRIER COATINGS

BACKGROUND OF THE INVENTION

This invention relates to a method for applying a thermal barrier coating to a metal substrate, or for repairing a previously applied thermal barrier coating on a metal substrate, of an article, in particular turbine engine components such as combustor deflector plates and assemblies, nozzles and the like. This invention further relates to a method for applying a thermal barrier coating, or repairing a previously applied thermal barrier coating, by plasma spray techniques where the underlying metal substrate has an overlaying aluminide diffusion coating.

Higher operating temperatures of gas turbine engines are continuously sought in order to increase their efficiency. However, as operating temperatures increase, the high temperature durability of the components of the engine must correspondingly increase. Significant advances in high temperature capabilities have been achieved through formulation of nickel and cobalt-base superalloys, though such alloys alone are often inadequate to form components located in certain sections of a gas turbine engine, such as turbine blades and vanes, turbine shrouds, buckets, nozzles, combustion liners and deflector plates, augmentors and the like. A common solution is to thermally insulate such components in order to minimize their service temperatures. For this purpose, thermal barrier coatings applied over the metal substrate of turbine components exposed to such high surface temperatures have found wide use.

To be effective, thermal barrier coatings should have low thermal conductivity (i.e., should thermally insulate the underlying metal substrate), strongly adhere to the metal substrate of the turbine component and remain adherent throughout many heating and cooling cycles. This latter requirement is particularly demanding due to the different coefficients of thermal expansion between materials having low thermal conductivity and superalloy materials typically used to form the metal substrate of the turbine component. Thermal barrier coatings capable of satisfying these requirements typically comprise a ceramic layer that overlays the metal substrate. Various ceramic materials have been employed as the ceramic layer, for example, chemically (metal oxide) stabilized zirconias such as yttria-stabilized zirconia, scandia-stabilized zirconia, calcia-stabilized zirconia, and magnesia-stabilized zirconia. The thermal barrier coating of choice is typically a yttria-stabilized zirconia ceramic coating, such as, for example, about 7% yttria and about 93% zirconia.

In order to promote adhesion of the ceramic layer to the underlying metal substrate and to prevent oxidation thereof, a bond coat layer is typically formed on the metal substrate from an oxidation-resistant overlay alloy coating such as MCrAlY where M can be iron, cobalt and/or nickel, or from an oxidation-resistant diffusion coating such as an aluminide, for example, nickel aluminide and platinum aluminide. To achieve greater temperature-thermal cycle time capability to increase servicing intervals, as well as the temperature capability of turbine components such as combustor splash or deflector plates of combustor (dome) assemblies, combustor nozzles and the like, an aluminide diffusion coating is initially applied to the metal substrate, typically by chemical vapor phase deposition (CVD). A ceramic layer is then typically applied to this aluminide coating by physical vapor deposition (PVD), such as electron beam physical vapor deposition (EB-PVD), to provide the thermal barrier coating. Usually, the various parts of the component (e.g., the deflector plates attached or joined to supporting structure such as the swirlers and backplate to form the combustor dome assembly, or airfoils to the inner and outer bands to form a nozzle) are coated separately with the aluminide diffusion coating before the ceramic layer is applied by PVD. See, for example, U.S. Pat. No. 6,442,940 (Young et al), issued Sep. 3, 2002 and U.S. Pat. No. 6,502,400 (Freidauer et al), issued Jan. 7, 2003 for combustor dome assemblies formed from a plurality of parts that are brazed together. These coated parts are then typically machined to remove the coating where the parts are to be joined to and then brazed to the supporting structure to provide the complete component protected by the thermal barrier coating.

Though significant advances have been made in improving the durability of thermal barrier coatings applied by PVD techniques, such coatings will typically require repair under certain circumstances, particularly gas turbine engine components that are subjected to intense heat and thermal cycling. The thermal barrier coating of the turbine engine component can also be susceptible to various types of damage, including objects ingested by the engine, erosion, oxidation, and attack from environmental contaminants, that will require repair of the coating. The problem of repairing such thermal barrier coatings is exacerbated when the component comprises an assembly of individually PVD coated parts that are machined and then brazed to a supporting structure or the like, as, for example, in the case of a combustor dome assembly. In removing the PVD-applied thermal barrier coating (e.g., by grit blasting), some or all of the underlying aluminide diffusion coating can be removed as well. Repairing or reapplying this aluminide diffusion coating while the component is in an assembled state is usually difficult, expensive and impractical.

Even more significant is the difficulty in repairing or reapplying the ceramic layer by PVD techniques while the component is an assembled state. Because of the processing conditions (usually heat) under which PVD techniques are carried out, repairing or reapplying the ceramic layer by PVD (especially EB-PVD) techniques can damage the brazed joints of the assembled component, as well as the supporting structure to which the parts are joined by brazing. As a result, the component is usually disassembled into its individual parts and then the PVD-applied thermal barrier coating is stripped or otherwise removed from the aluminide diffusion coating, such as by grit blasting. The thermal barrier coating can then be reapplied by PVD techniques to the individual stripped parts (with or without prior repair of the underlying aluminide diffusion coating), followed by machining and rebrazing of these PVD recoated parts to the supporting structure to once again provide a complete component. Such a repair process can be labor-intensive, time consuming, expensive and impractical.

In some instances, it can also be desirable to apply a thermal barrier coating by plasma spray (particularly air plasma spray) techniques to the metal substrate of the turbine engine component where the underlying metal substrate has an aluminide diffusion coating. Plasma spray techniques for applying the thermal barrier coating would also be desirable in repairing damaged PVD-applied thermal barrier coatings because the conditions under which plasma spray coatings are applied does not damage brazed joints and would allow the damaged thermal barrier coating to be repaired without disassembly of the component. However, for plasma spray-applied thermal barrier coatings to properly adhere, typically an overlay alloy bond coat layer (e.g., MCrAlY) needs to be applied to the aluminide diffusion coating. However, applying this overlay alloy bond coat layer to an aluminide diffusion coating by plasma spray techniques, especially air plasma spray techniques, is not without problems. In many instances, plasma spray-applied overlay alloy bond coats will not consistently adhere to the surface of the aluminide diffusion coat layer. This also makes it difficult to use plasma spray techniques in place of PVD techniques to repair a damaged PVD-applied thermal barrier coating.

Accordingly, it would be desirable to provide a method for repairing such components having PVD-applied thermal barrier coatings that reduces the cost and time of such repairs and can be employed on a wide variety of turbine engine components, such as combustor deflector plate assemblies and combustor nozzles. It would be further desirable to provide a method capable of applying a thermal barrier coating by plasma spray techniques to a metal substrate that has an overlaying aluminide diffusion coating.

BRIEF DESCRIPTION OF THE INVENTION

An embodiment of this invention relates to a method for applying a thermal barrier coating to an underlying metal substrate where the metal substrate has an overlaying aluminide diffusion coating. This method comprises the steps of:

(1) treating the aluminide diffusion coating to make it more receptive to adherence of a plasma spray-applied overlay alloy bond coat layer;

(2) plasma spraying an overlay alloy bond coat material on the treated diffusion coating to form an overlay alloy bond coat layer; and (3) optionally plasma spraying a ceramic thermal barrier coating material on the overlay alloy bond coat layer to form the thermal barrier coating.

Another embodiment of this invention relates to a method for repairing a thermal barrier coating applied by physical vapor deposition to an underlying aluminide diffusion coating that overlays the metal substrate. This method comprises the steps of:

(1) removing the physical vapor deposition-applied thermal barrier coating from the underlying aluminide diffusion coating;

(2) treating the diffusion coating to make it more receptive to adherence of a plasma spray-applied overlay alloy bond coat layer;

(3) plasma spraying an overlay alloy bond coat material on the treated diffusion coating to form an overlay alloy bond coat layer; and (4) optionally plasma spraying a ceramic thermal barrier coating material on the overlay alloy bond coat layer to form the thermal barrier coating.

The embodiments of the method of this invention for applying a plasma sprayed thermal barrier coating and for repairing a physical vapor deposition-applied thermal barrier coating provide several benefits. These methods allow a plasma sprayed thermal barrier coating to be applied to an underlying diffusion aluminide coating that overlays the metal substrate of turbine component, such as a combustor deflector plate assembly or combustor nozzle, in a manner that insures adequate adherence of the plasma sprayed thermal barrier coating. These methods also allow the repair of physical vapor deposition-applied thermal barrier coatings without the need to take apart or disassemble the component and without damaging portions of the component, including brazed joints and supporting structures. These methods also allow a relatively less time consuming and uncomplicated way to apply or repair these thermal barrier coating and are relatively inexpensive to carry out. These methods also permit the use of more flexible plasma spray techniques that can be carried out in air and at relatively low temperatures, e.g., typically less than about 800° F. (about 427° C.). By contrast, physical vapor deposition techniques are less flexible and are typically carried out in a vacuum in a relatively small coating chamber and at much higher temperatures, e.g., typically in the range of from about 1750° to about 2000° F. (from about 954° to about 1093° C.).

DETAILED DESCRIPTION OF THE INVENTION

Figure 1:
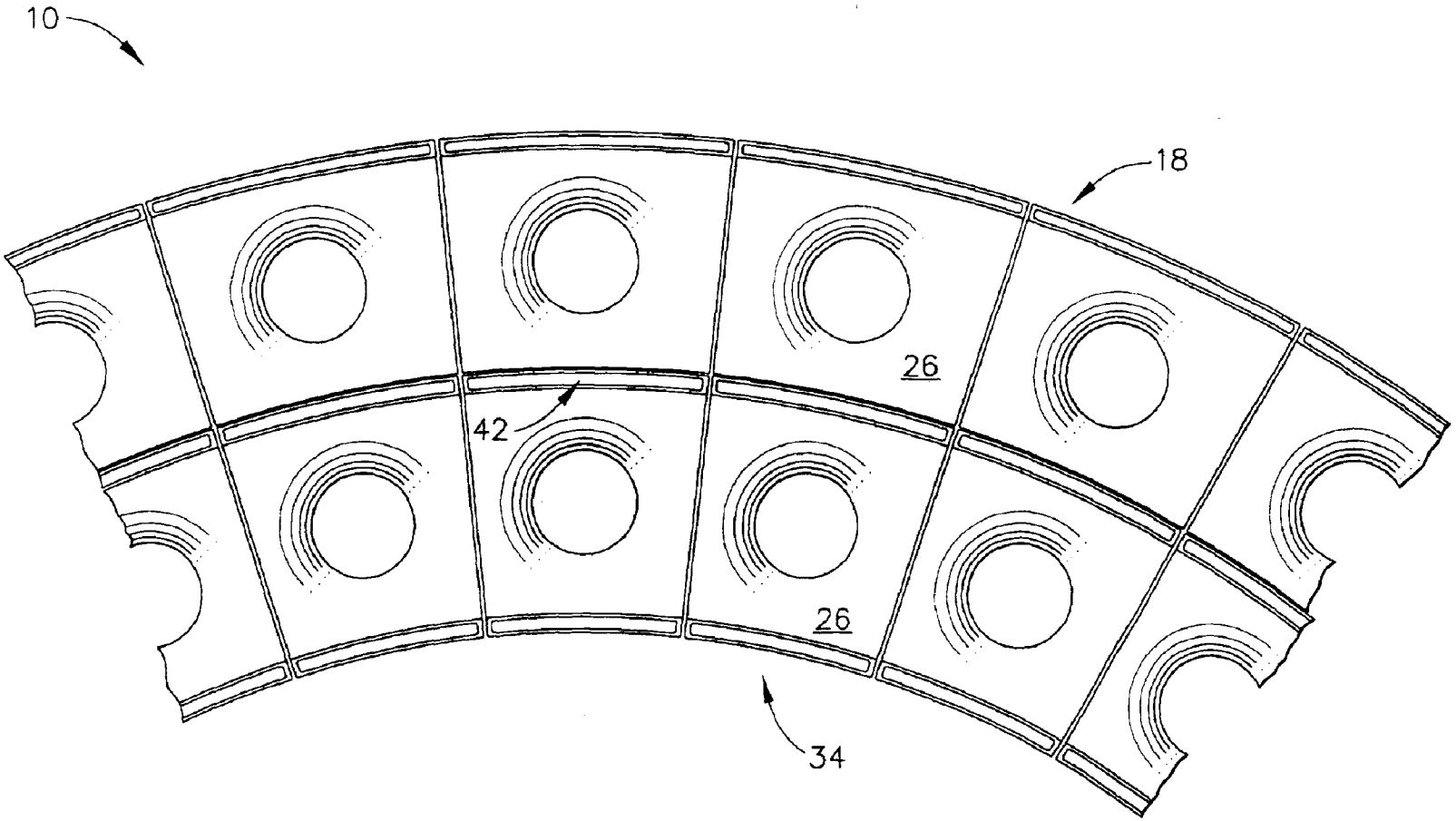
FIG. 1 is a partial plan view of a combustor deflector dome assembly for a gas turbine engine with two annular arrays of coated deflector plates.

As used herein, the term "ceramic thermal barrier coating materials" refers to those coating materials that are capable of reducing heat flow to the underlying metal substrate of the article, i.e., forming a thermal barrier and usually having a melting point of at least about 2000° F. (1093° C.), typically at least about 2200° F. (1204° C.), and more typically in the range from about 2200° to about 3500° F. (from about 1204° to about 1927° C.). Suitable ceramic thermal barrier coating materials for use herein include, aluminum oxide (alumina), i.e., those compounds and compositions comprising $Al_2O_3$, including unhydrated and hydrated forms, various zirconias, in particular chemically stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias as well as mixtures of such stabilized zirconias. See, for example, Kirk-Othmer's Encyclopedia of Chemical Technology, 3rd Ed., Vol. 24, pp. 882–883 (1984) for a description of suitable zirconias. Suitable yttria-stabilized zirconias can comprise from about 1 to about 20% yttria (based on the combined weight of yttria and zirconia), and more typically from about 3 to about 10% yttria. These chemically stabilized zirconias can further include one or more of a second metal (e.g., a lanthanide or actinide) oxide such as dysprosia, erbia, europia, gadolinia, neodymia, praseodymia, urania, and hafnia to further reduce thermal conductivity of the thermal barrier coating. See U.S. Pat. No. 6,025,078 (Rickersby et al), issued Feb. 15, 2000 and U.S. Pat. No. 6,333,118 (Alperine et al), issued Dec. 21, 2001, both of which are incorporated by reference. Suitable non-alumina ceramic thermal barrier coating materials also include pyrochlores of general formula $A_2B_2O_7$ where A is a metal having a valence of 3+ or 2+ (e.g., gadolinium, aluminum, cerium, lanthanum or yttrium) and B is a metal having a valence of 4+ or 5+ (e.g., hafnium, titanium, cerium or zirconium) where the sum of the A and B valences is 7. Representative materials of this type include gadolinium-zirconate, lanthanum titanate, lanthanum zirconate, yttrium zirconate, lanthanum hafnate, cerium zirconate, aluminum cerate, cerium hafnate, aluminum hafnate and lanthanum cerate. See U.S. Pat. No. 6,117,560 (Maloney), issued Sep. 12, 2000; U.S. Pat. No. 6,177,200 (Maloney), issued Jan. 23, 2001; U.S. Pat. No. 6,284,323 (Maloney), issued Sep. 4, 2001; U.S. Pat. No. 6,319,614 (Beele), issued Nov. 20, 2001; and U.S. Pat. No. 6,387,526 (Beele), issued May 14, 2002, all of which are incorporated by reference.

As used herein, the term "aluminide diffusion coating" refers to coatings containing various Nobel metal aluminides such as nickel aluminide and platinum aluminide, as well as simple aluminides (i.e., those formed without Nobel metals), and typically formed on metal substrates by chemical vapor phase deposition (CVD) techniques. See, for example, U.S. Pat. No. 4,148,275 (Benden et al), issued Apr. 10, 1979; U.S. Pat. No. 5,928,725 (Howard et al), issued Jul. 27, 1999; and See U.S. Pat. No. 6,039,810 (Mantkowski et al), issued Mar. 21, 2000 (all of which are incorporated by reference), which disclose various apparatus and methods for applying aluminide diffusion coatings by CVD.

As used herein, the term "overlay alloy bond coating materials" refers to those materials containing various metal alloys such as MCrAlY alloys, where M is a metal such as iron, nickel, platinum, cobalt or alloys thereof.

As used herein, the term "physical vapor deposition-applied thermal barrier coating" refers to a thermal barrier coating that is applied by various physical vapor phase deposition (PVD) techniques, including electron beam physical vapor deposition (EB-PVD). See, for example, U.S. Pat. No. 5,645,893 (Rickerby et al), issued Jul. 8, 1997 (especially col. 3, lines 36–63) and U.S. Pat. No. 5,716,720 (Murphy), issued Feb. 10, 1998) (especially col. 5, lines 24–61) (all of which are incorporated by reference), which disclose various apparatus and methods for applying thermal barrier coatings by PVD techniques, including EB-PVD techniques. PVD techniques tend to form coatings having a porous strain-tolerant columnar structure. See FIG. 3.

As used herein, the term "comprising" means various compositions, compounds, components, layers, steps and the like can be conjointly employed in the present invention. Accordingly, the term "comprising" encompasses the more restrictive terms "consisting essentially of" and "consisting of."

All amounts, parts, ratios and percentages used herein are by weight unless otherwise specified.

The embodiments of the method of this invention are useful in applying or repairing thermal barrier coatings for a wide variety of turbine engine (e.g., gas turbine engine) parts and components that are formed from metal substrates comprising a variety of metals and metal alloys, including superalloys, and are operated at, or exposed to, high temperatures, especially higher temperatures that occur during normal engine operation. These turbine engine parts and components can include turbine airfoils such as blades and vanes, turbine shrouds, turbine nozzles, combustor components such as liners, deflectors and their respective dome assemblies, augmentor hardware of gas turbine engines and the like.

The embodiments of the method of this invention are particularly useful in applying or repairing thermal barrier coatings to turbine engine components comprising assembled parts joined or otherwise attached to a support structure(s) (e.g., such as by brazing), for example, combustor deflector plate assemblies and combustor nozzle assemblies. For such components, the thermal barrier coating to be applied or repaired is typically a part and more typically plurality of parts (e.g., deflector plates in the case of a combustor deflector assembly, or airfoils in the case of a nozzle assembly) that is joined or attached (e.g., such by brazing) to the support structure. Indeed, the embodiments of the method of this invention are particularly suitable for applying or repairing such assembled components without the need to take apart or disassemble the component and without damaging portions of the component, including brazed joints and supporting structures. See, for example, U.S. Pat. No. 6,442,940 (Young et al), issued Sep. 3, 2002 and U.S. Pat. No. 6,502,400 (Freidauer et al), issued Jan. 7, 2003 (both of which are incorporated by reference) for combustor dome assemblies formed from a plurality of parts that are brazed together for which embodiments of the method of this invention can be useful in applying or repairing thermal barrier coatings. While the following discussion of an embodiment of the method of this invention will be with reference to combustor deflector dome assemblies and especially the respective splash or deflector plates that comprise these assemblies and have thermal barrier coatings overlaying the metal substrate, it should also be understood that methods of this invention can be useful with other articles comprising metal substrates that operate at, or are exposed to, high temperatures, that have or require thermal barrier coatings.

The various embodiments of the method of this invention are further illustrated by reference to the drawings as described hereafter. Referring to the drawings, FIG. 1 shows a combustor deflector dome assembly indicated generally as 10. Dome assembly 10 is shown as having an outer first annular deflector plate array indicated generally as 18 comprising a plurality of deflector plates 26 and an adjacent inner annular deflector plate array indicated generally as 34 also comprising a plurality of deflector plates 26. While dome assembly 10 is shown as having two annular deflector plate arrays 18 and 34, it should be understood that dome assembly could also comprise a single annular deflector plate array or more than two annular deflector plate arrays (e.g., three annular arrays of such deflector plates 26). These annular deflector plate arrays 18 and 34 are usually supported by a matrix comprising a plurality of swirlers (not shown) and a backing plate indicated generally as 42. The deflector plates 26 of these annular arrays 18 and 34 are typically joined or otherwise attached to the support structure, such as backing plate 42, by brazing techniques well known to those skilled in the art.

Figure 2:
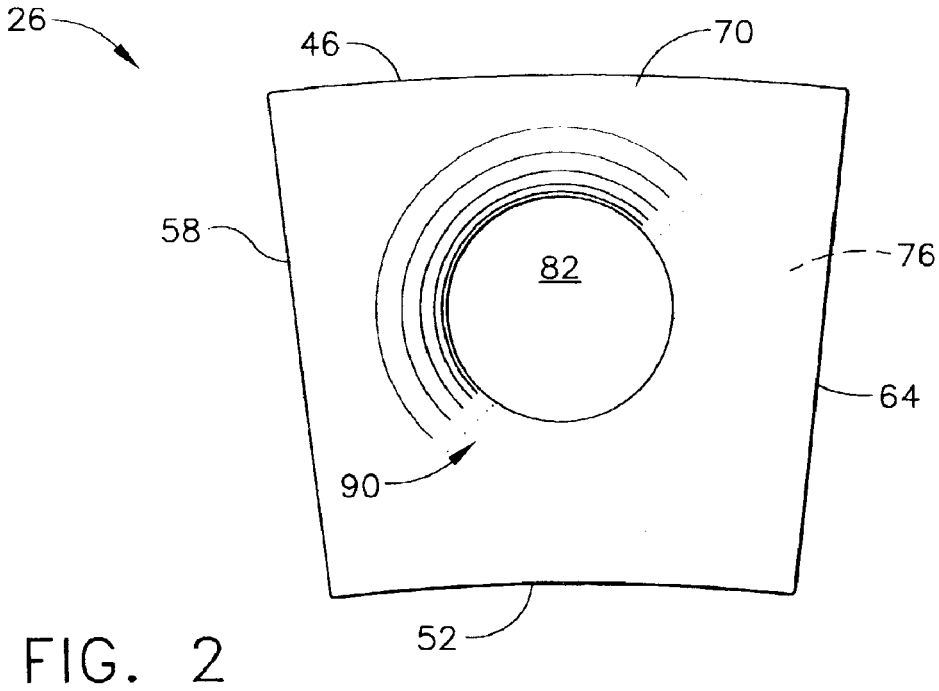
FIG. 2 is a plan view of one of the coated deflector plates of FIG. 1.

One such deflector plate 26 is shown in FIG. 2 as having a generally rectangular or trapezoidal shape and comprises a curved outer edge 46, an opposite inner curved edge 52, opposite sides 58 and 64 that slant towards each other in the direction towards inner edge 52, a front face or surface 70 and a back face or surface 76. Surface 70 has a central opening or aperture 82 formed therein defined by a substantially ring-shaped annular wall 90 that becomes progressively smaller in diameter in the direction from surface 70 to surface 76. See also, for example, U.S. Pat. No. 4,914,918 (Sullivan), issued Apr. 10, 1990, for other combustor deflector assemblies having deflector segments for which the embodiments of the method of this invention can be useful.

The front and back surfaces 70 and 76 each typically have an aluminide diffusion coating. However, because front surface 70 is opposite the fuel injector (not shown), it typically has an outer thermal barrier coating to protect the front surface 70, as well as the remainder of deflector plate 26 and assembly 10, from heat damage. This is particularly illustrated in FIG. 5 which shows deflector 26 comprising a metal substrate indicated generally as 100. Substrate 100 can comprise any of a variety of metals, or more typically metal alloys, that are typically protected by thermal barrier coatings, including those based on nickel, cobalt and/or iron alloys. For example, substrate 100 can comprise a high temperature, heat-resistant alloy, e.g., a superalloy. Such high temperature alloys are disclosed in various references, such as U.S. Pat. No. 5,399,313 (Ross et al), issued Mar. 21, 1995 and U.S. Pat. No. 4,116,723 (Gell et al), issued Sep. 26, 1978, both of which are incorporated by reference. High temperature alloys are also generally described in Kirk-Othmer's Encyclopedia of Chemical Technology, 3rd Ed., Vol. 12, pp. 417–479 (1980), and Vol. 15, pp. 787–800 (1981). Illustrative high temperature nickel-based alloys are designated by the trade names Inconel®, Nimonic®, Rene® (e.g., Rene® 80-, Rene® 95 alloys), and Udimet®.

Figure 3:
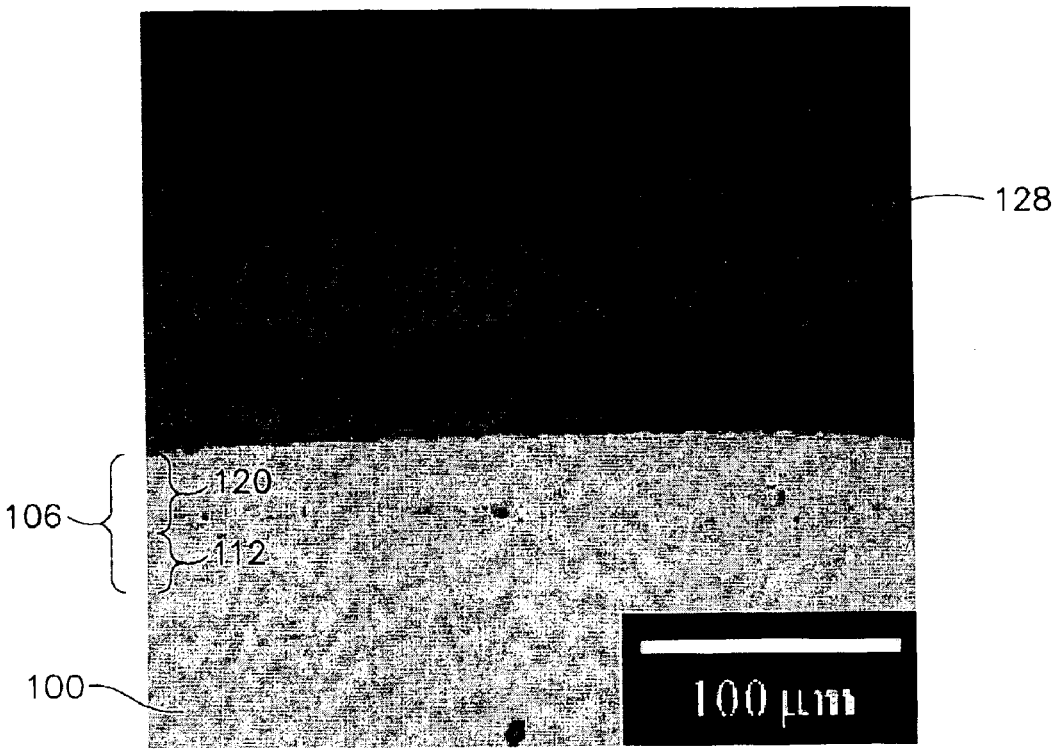
FIG. 3 is an image showing a side sectional view of a PVD-coated deflector plate prior to repair.
Figure 4:
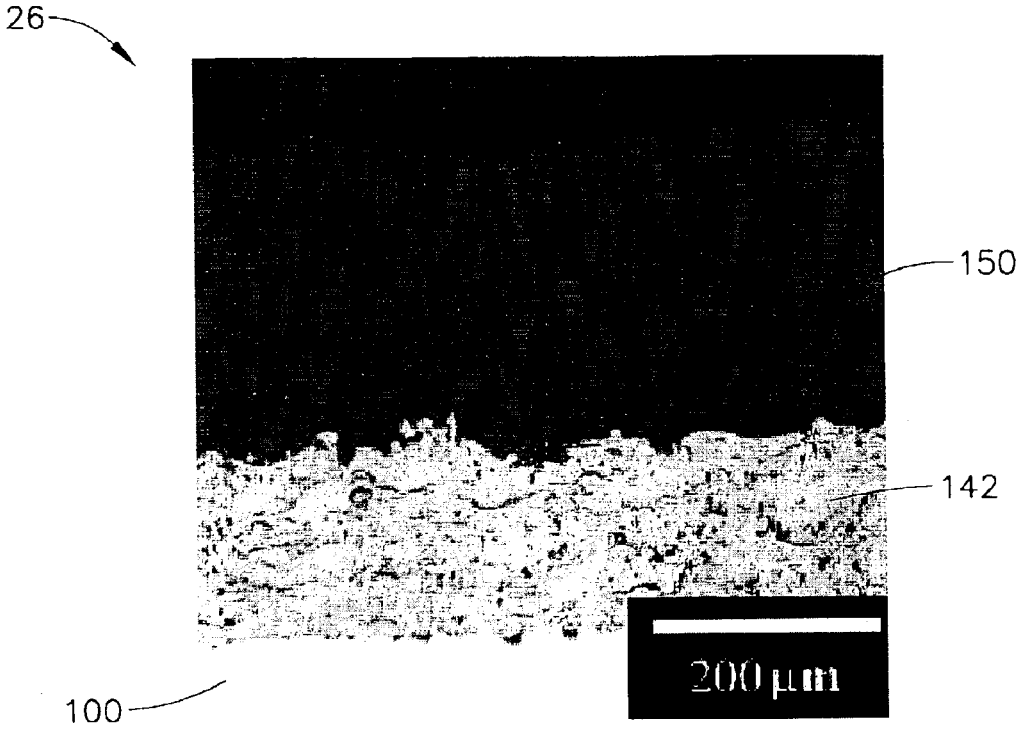
FIG. 4 is an image showing a side sectional view of a coated deflector plate like that of FIG. 3 after it has been repaired by an embodiment of this invention.
Figure 5:
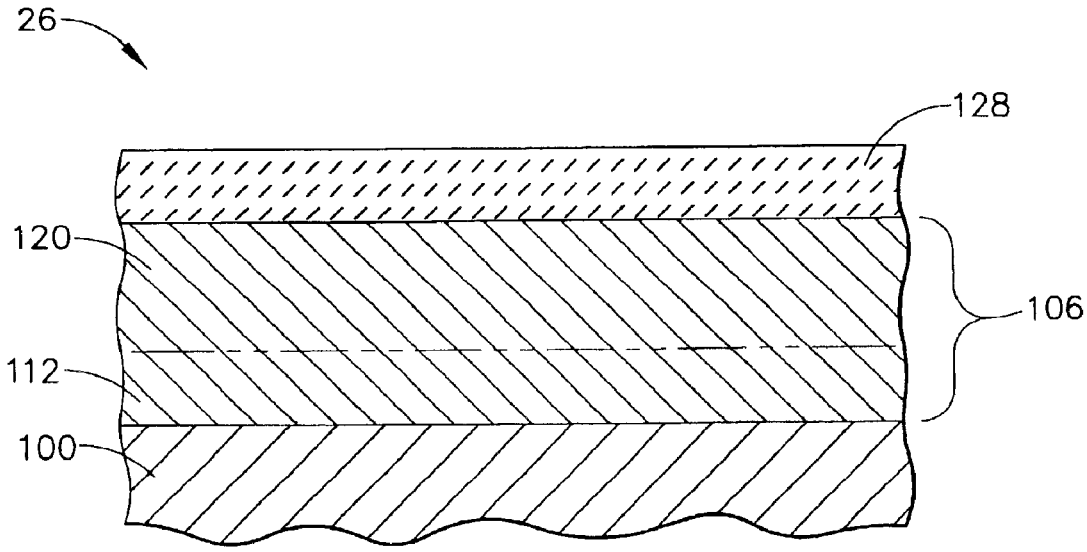
FIG. 5 is a cross-sectional representation of a PVD-coated deflector plate prior to repair.

As shown in FIG. 5, adjacent and overlaying substrate 100 is an aluminide diffusion coating indicated generally as 106. This diffusion coating 106 typically has a thickness of from about 0.5 to about 4 mils (from about 12 to about 100 microns), more typically from about 2 to about 3 mils (from about 50 to about 75 microns). This diffusion coating 106 typically comprises an inner diffusion layer 112 (typically from about 30 to about 60% of the thickness of coating 106, more typically from about 40 to about 50% of the thickness of coating 106) directly adjacent substrate 100 and an outer additive layer 120 (typically from about 40 to about 70% of the thickness of coating 106, more typically from about 50 to about 60% of the thickness of coating 106). As also shown in FIG. 5, adjacent and overlaying additive layer 120 is a thermal barrier coating (TBC) indicated generally as 128. This TBC 128 shown in FIG. 5 has been formed on diffusion coating 106 by physical vapor deposition (PVD) techniques, such as electron beam physical vapor deposition (EB-PVD). This TBC 128 typically has a thickness of from about 1 to about 30 mils (from about 25 to about 769 microns), more typically from about 3 to about 20 mils (from about 75 to about 513 microns). As shown in FIG. 3, this TBC 128 formed by PVD techniques has a porous strain-tolerant columnar structure.

Over time and during normal engine operation, TBC 128 will become of damaged, e.g., by foreign objects ingested by the engine, erosion, oxidation, and attack from environmental contaminants. Such damaged TBCs 128 will then typically need to be repaired. In an embodiment of the method of this invention, this initial step involves stripping off, or otherwise removing TBC 128 from diffusion coating 106. TBC 128 can be removed by any suitable method known to those skilled in the art for removing PVD-applied TBCs. Methods for removing such PVD-applied TBCs can be by mechanical removal, chemical removal, and any combination thereof. Suitable removal methods include grit blasting, with or without masking of surfaces that are not to be subjected to grit blasting (see U.S. Pat. No. 5,723,078 to Niagara et al, issued Mar. 3, 1998, especially col. 4, lines 46–66, which is incorporated by reference), micromachining, laser etching (see U.S. Pat. No. 5,723,078 to Niagara et al, issued Mar. 3, 1998, especially col. 4, line 67 to col. 5, line 3 and 14–17, which is incorporated by reference), treatment (such as by photolithography) with chemical etchants for TBC 128 such as those containing hydrochloric acid, hydrofluoric acid, nitric acid, ammonium bifluorides and mixtures thereof, (see, for example, U.S. Pat. No. 5,723,078 to Nagaraj et al, issued Mar. 3, 1998, especially col. 5, lines 3–10; U.S. Pat. No. 4,563,239 to Adinolfi et al, issued Jan. 7, 1986, especially col. 2, line 67 to col. 3, line 7; U.S. Pat. No. 4,353,780 to Fishter et al, issued Oct. 12, 1982, especially col. 1, lines 50–58; and U.S. Pat. No. 4,411,730 to Fishter et al, issued Oct. 25, 1983, especially col. 2, lines 40–51, all of which are incorporated by reference), treatment with water under pressure (i.e., water jet treatment), with or without loading with abrasive particles, as well as various combinations of these methods. Typically, TBC 128 is removed by grit blasting where TBC 128 is subjected to the abrasive action of silicon carbide particles, steel particles, alumina particles or other types of abrasive particles. These particles used in grit blasting are typically alumina particles and typically have a particle size of from about 220 to about 35 mesh (from about 63 to about 500 micrometers), more typically from about 80 to about 60 mesh (from about 180 to about 250 micrometers).

Figure 6:
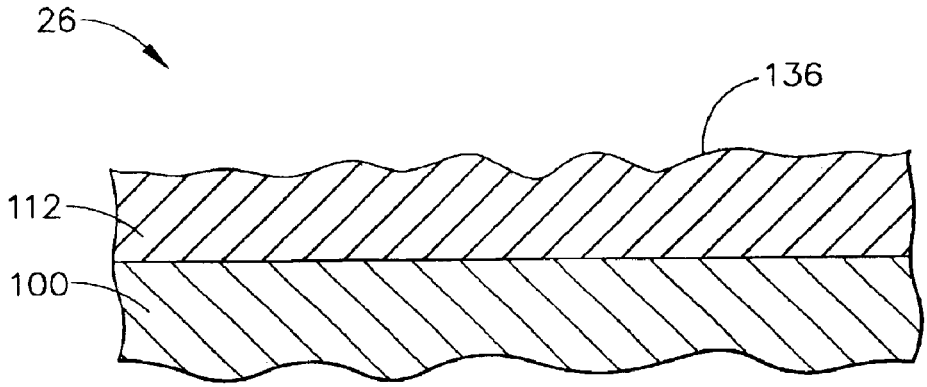
FIGS. 6 and 7 are cross-sectional representations of the repair steps of an embodiment of this invention.

After TBC 128 is removed, diffusion layer 106 is then treated to make it more receptive to adherence of an overlay alloy bond coat layer to be later formed by plasma spray techniques. This diffusion layer 106 can be treated by any of the methods, or combinations of methods, previously described for removing TBC 128. See U.S. Pat. No. 5,723.078 to Nagaraj et al, issued Mar. 3, 1998, especially col. 4, lines 46–66 (herein incorporated by reference) for a suitable method involving grit blasting. See also U.S. Pat. No. 4,339.282 to Lada et al, issued Jul. 13, 1982 for a suitable method removing nickel aluminide coatings with chemical etchants. The treatment of diffusion layer 106 can be a separate treatment step or can be a continuation of the treatment step by which TBC 128 is removed, with or without modification of the treatment conditions. Typically, grit blasting is used to remove, roughen or otherwise texturize diffusion coating 106. As shown in FIG. 6, such texturizing or roughening typically removes all or substantially all of the additive layer 120, and at least a majority of diffusion layer 112, leaving behind a residual diffusion layer 112 (typically from 0 to about 75% of the original thickness of coating 106, more typically from about 5 to about 20% of the original thickness of coating 106) having a textured or roughened outer surface indicated as 136. For example, after treatment of diffusion layer 112 by grit blasting, surface 136 usually has an average surface roughness $R_a$ of at least about 80 microinches, and typically in the range of from about 80 to about 200 microinches, more typically from about 100 to about 150 microinches.

Figure 7:
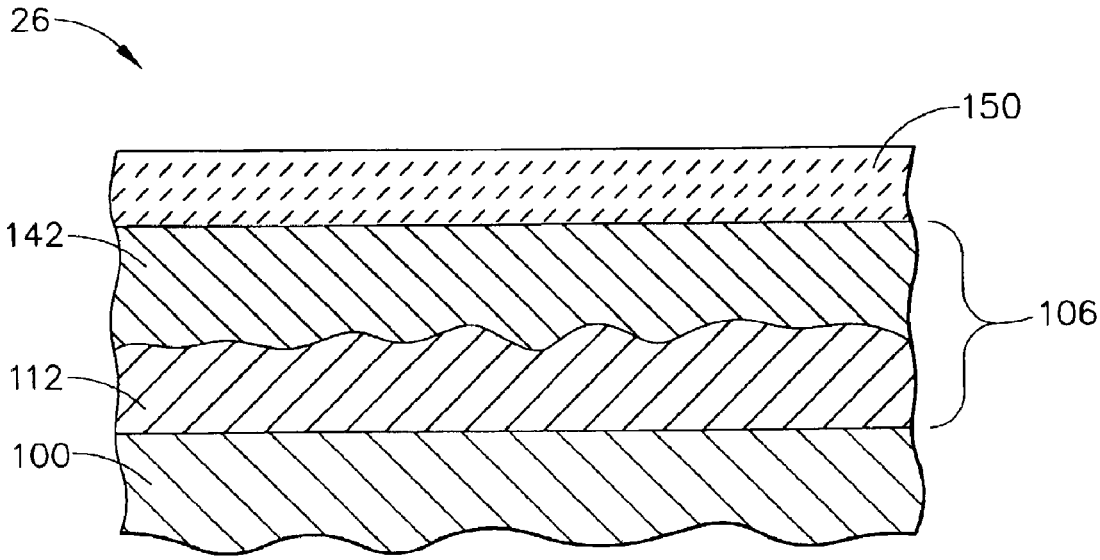

As shown in FIG. 7, after diffusion layer 106 has been treated to make it more receptive, a suitable overlay alloy bond coat material is then deposited on the treated aluminide diffusion coating to form an overlay alloy bond coat layer indicated generally as 142. This overlay alloy bond coat layer 142 typically has a thickness of from about 1 to about 19.5 mils (from about 25 to about 500 microns), more typically from about 3 to about 15 mils (from about 75 to about 385 microns). After overlay alloy bond coat layer 142 has been formed, a suitable ceramic thermal barrier coating material is then deposited on layer 142 to form TBC 150. The thickness of TBC 150 is typically in the range of from about 1 to about 100 mils (from about 25 to about 2564 microns) and will depend upon a variety of factors, including the article that is involved. For example, for turbine shrouds, TBC 150 is typically thicker and is usually in the range of from about 30 to about 70 mils (from about 769 to about 1795 microns), more typically from about 40 to about 60 mils (from about 1333 to about 1538 microns). By contrast, in the case of deflector plates 26, TBC 150 is typically thinner and is usually in the range of from about 5 to about 40 mils (from about 128 to about 1026 microns), more typically from about 10 to about 30 mils (from about 256 to about 769 microns).

The respective bond coat layer 142 and TBC 150 can be formed by any suitable plasma spray technique well known to those skilled in the art. See, for example, Kirk-Othmer Encyclopedia of Chemical Technology, 3rd Ed., Vol. 15, page 255, and references noted therein, as well as U.S. Pat. No. 5,332,598 (Kawasaki et al), issued Jul. 26, 1994; U.S. Pat. No. 5,047,612 (Savkar et al) issued Sep. 10, 1991; and U.S. Pat. No. 4,741,286 (Itoh et al), issued May 3, 1998 (herein incorporated by reference) which are instructive in regard to various aspects of plasma spraying suitable for use herein. In general, typical plasma spray techniques involve the formation of a high-temperature plasma, which produces a thermal plume. The thermal barrier coating materials, e.g., ceramic powders, are fed into the plume, and the high-velocity plume is directed toward the bond coat layer 142. Various details of such plasma spray coating techniques will be well-known to those skilled in the art, including various relevant steps and process parameters such as cleaning of the bond coat surface prior to deposition; plasma spray parameters such as spray distances (gun-to-substrate), selection of the number of spray-passes, powder feed rates, particle velocity, torch power, plasma gas selection, oxidation control to adjust oxide stoichiometry, angle-of-deposition, post-treatment of the applied coating; and the like. Torch power can vary in the range of about 10 kilowatts to about 200 kilowatts, and in preferred embodiments, ranges from about 40 kilowatts to about 60 kilowatts. The velocity of the thermal barrier coating material particles flowing into the plasma plume (or plasma "jet") is another parameter which is usually controlled very closely.

Suitable plasma spray systems are described in, for example, U.S. Pat. No. 5,047,612 (Savkar et al) issued Sep. 10, 1991, which is incorporated by reference. Briefly, a typical plasma spray system includes a plasma gun anode which has a nozzle pointed in the direction of the deposit-surface of the substrate being coated. The plasma gun is often controlled automatically, e.g., by a robotic mechanism, which is capable of moving the gun in various patterns across the substrate surface. The plasma plume extends in an axial direction between the exit of the plasma gun anode and the substrate surface. Some sort of powder injection means is disposed at a predetermined, desired axial location between the anode and the substrate surface. In some embodiments of such systems, the powder injection means is spaced apart in a radial sense from the plasma plume region, and an injector tube for the powder material is situated in a position so that it can direct the powder into the plasma plume at a desired angle. The powder particles, entrained in a carrier gas, are propelled through the injector and into the plasma plume. The particles are then heated in the plasma and propelled toward the substrate. The particles melt, impact on the substrate, and quickly cool to form the thermal barrier coating.

While the prior description of the embodiment of the method of this invention has been with reference to repairing an existing PVD-applied TBC 128, another embodiment of the method of this invention can be used to form a newly applied TBC 150. In the embodiment of this method, a substrate 100 having an aluminide diffusion coating 106 is treated as before to roughen or texturize the coating, as previously described and as shown in FIG. 6. The overlay diffusion bond coat layer 142 and TBC 150 are then formed, as previously described and as shown in FIG. 7.

While specific embodiments of the method of the present invention have been described, it will be apparent to those skilled in the art that various modifications thereto can be made without departing from the spirit and scope of the present invention as defined in the appended claims.

What is claimed is:

1. A method for repairing a thermal barrier coating applied by physical vapor deposition to an underlying aluminide diffusion coating that overlays a metal substrate of at least one part of an assembled turbine component, the method comprising the steps of:

(1) while the turbine component is in an assembled state, removing the physical vapor deposition-applied thermal barrier coating from the underlying aluminide diffusion coating of the least one part;

(2) roughening the diffusion coating to make it more receptive to adherence of a plasma spray-applied overlay alloy bond coat layer;

(3) plasma spraying an overlay alloy bond coat material on the roughened diffusion coating to form an overlay alloy bond coat layer; and (4) plasma spraying a ceramic thermal barrier coating material on the overlay alloy bond coat layer to form a thermal barrier coating.

2. The method of claim 1 wherein step (1) is carried out by grit blasting the physical vapor deposition-applied thermal barrier coating.

3. The method of claim 2 wherein step (2) is carried out by grit blasting the diffusion coating so as to have an outer textured surface having an average surface roughness $R_a$ of at least about 80 microinches.

4. The method of claim 3 wherein the diffusion coating has a thickness of from about 0.5 to about 4 mils and is grit blasted during step (2) so that the outer textured surface has an average surface roughness $R_a$ of from about 80 to about 200 microinches.

5. The method of claim 4 wherein the diffusion coating has a thickness of from about 2 to about 3 mils and is grit blasted during step (1) so that the outer textured surface has an average surface roughness $R_a$ of from about 100 to about 150 microinches.

6. The method of claim 3 (wherein step (3) is carried out by plasma spraying on the aluminide diffusion coating an MCrAlY alloy, wherein M is a metal selected from the group consisting of iron, nickel, platinum, cobalt or alloys thereof.

7. The method of claim 6 wherein step (3) is carried out by plasma spraying on the roughened diffusion coating an MCrAlY alloy to form an overlay alloy bond coat layer having a thickness of from about 1 to about 19.5 mils.

8. The method of claim 7 wherein step (3) is carried out by plasma spraying on the overlay alloy bond coat layer a chemically stabilized zirconia selected from the group consisting of yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias and mixtures thereof.

9. The method of claim 8 wherein step (4) is carried out by plasma spraying on the overlay alloy bond coat layer a chemically stabilized zirconia to form a thermal barrier coating having a thickness of from about 5 to about 40 mils.

10. The method of claim 9 wherein step (4) is carried out by plasma spraying on the overlay alloy bond coat layer a chemically stabilized zirconia to form a thermal barrier coating having a thickness of from about 10 to about 30 mils.

11. The method of claim 10 wherein step (3) is carried out by air plasma spraying the MCrAlY alloy on the roughened diffusion coating and wherein step (4) is carried out by air plasma spraying the chemically stabilized zirconia on the overlay alloy bond coat layer.

12. The method of claim 1 for repairing an assembled component that is a combustor deflector assembly and wherein the at least one part is a deflector plate having a front face and a back face, wherein the front face has a thermal barrier coating applied by physical vapor deposition.

* * * * *